US010293625B2

(12) United States Patent
Sanjuan et al.

(10) Patent No.: US 10,293,625 B2
(45) Date of Patent: May 21, 2019

(54) PRINT BAR FOR A MULTI-PASS PRINTER AND MULTI-PASS PAGE-WIDE-ARRAY PRINTER

(71) Applicant: HEWLETT-PACKARD DEVELOPMENT COMPANY, L.P., Houston, TX (US)

(72) Inventors: Joan Sanjuan, Sant Cugat del Valles (ES); Fernando Juan, Viladecavalls (ES); Eduardo Ruiz Martinez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 62 days.

(21) Appl. No.: 15/546,756

(22) PCT Filed: Apr. 24, 2015

(86) PCT No.: PCT/IB2015/001047
§ 371 (c)(1),
(2) Date: Jul. 27, 2017

(87) PCT Pub. No.: WO2016/170383
PCT Pub. Date: Oct. 27, 2016

(65) Prior Publication Data
US 2018/0022122 A1 Jan. 25, 2018

(51) Int. Cl.
*B41J 2/155* (2006.01)
*B41J 2/21* (2006.01)
(Continued)

(52) U.S. Cl.
CPC ..... *B41J 25/001* (2013.01); *B41J 2/155* (2013.01); *B41J 2/16585* (2013.01);
(Continued)

(58) Field of Classification Search
CPC ..... B41J 2/155; B41J 2/16585; B41J 2/2132; B41J 2/2146; B41J 2/515; B41J 19/00;
(Continued)

(56) References Cited

U.S. PATENT DOCUMENTS 4,920,421 A 4/1990 Stemmie
6,189,991 B1 * 2/2001 Wen ..... B41J 2/155 347/13

(Continued)

FOREIGN PATENT DOCUMENTS

EP 1182044 2/2002
EP 1201448 5/2002

(Continued)

OTHER PUBLICATIONS

HP, PCT PRO, Innovation at Work, Powering UK businesses, The technology behind the HP OfficeJet Pro X, Jan. 20, 2014 (10 pages).

*Primary Examiner* — Anh T. N. Vo
(74) *Attorney, Agent, or Firm* — HP Inc. Patent Department

(57) ABSTRACT

A print bar for a for a multi-pass printer, the print bar comprising a static part configured to extend across a print area of a print target and a moveable part comprising a print bar beam and printer comprising such a print bar.

13 Claims, 9 Drawing Sheets

(51) Int. Cl.

| | |
|---|---|
| ***B41J 25/00*** | (2006.01) |
| ***B41J 25/304*** | (2006.01) |
| ***B41J 2/515*** | (2006.01) |
| ***B41J 2/165*** | (2006.01) |
| ***B41J 19/00*** | (2006.01) |
| ***B41J 19/20*** | (2006.01) |

(52) U.S. Cl.
CPC ..... *B41J 2/2132* (2013.01); *B41J 2/2146* (2013.01); *B41J 2/515* (2013.01); *B41J 19/00* (2013.01); *B41J 19/207* (2013.01); *B41J 25/304* (2013.01); *B41J 2202/21* (2013.01)

(58) Field of Classification Search
CPC .... B41J 19/207; B41J 25/0011; B41J 25/304; B41J 2202/20; B41J 2202/21

See application file for complete search history.

(56) References Cited

U.S. PATENT DOCUMENTS

| | | | | |
|---|---|---|---|---|
| 7,407,256 | B2 | 8/2008 | Han | |
| 7,673,965 | B2 * | 3/2010 | Mills | B41J 2/155 347/13 |
| 7,850,271 | B2 | 12/2010 | Gothait et al. | |
| 8,057,010 | B2 | 11/2011 | Puigardeu et al. | |
| 2006/0227157 | A1 * | 10/2006 | Drake | B41J 2/2146 347/13 |
| 2010/0279081 | A1 * | 11/2010 | Koele | B41J 2/2132 428/195.1 |
| 2011/0298849 | A1 | 12/2011 | Murayama et al. | |
| 2012/0056924 | A1 | 3/2012 | Yoshida et al. | |
| 2012/0182342 | A1 | 7/2012 | Lin et al. | |
| 2014/0300664 | A1 | 10/2014 | Ulacia et al. | |

FOREIGN PATENT DOCUMENTS

| | | |
|---|---|---|
| EP | 1870239 | 12/2007 |
| WO | WO-2014008910 | 1/2014 |
| WO | WO-2014161569 | 10/2014 |

* cited by examiner

PRINT BAR FOR A MULTI-PASS PRINTER AND MULTI-PASS PAGE-WIDE-ARRAY PRINTER

BACKGROUND

Printers, like page-wide-array printers and multi-pass printers, include a print bar having a print head or array of print heads. Usually, the print bar extends at least across the width of a print substrate (e.g. paper) in the case of 2D printers or a build material in the case of 3D printers. A print head comprises one or more nozzles for ejecting printing fluid (e.g. ink) to be printed onto the print substrate or, in the case of 3D printers, for emitting radiation (e.g. light) to interact with build material in order to generate a 3D print out. In the following, the term "print target" covers both a print substrate used in 2D printers and build material used in 3D printers. Likewise the term "print" applies to 2D printers and 3D printers, wherein in the latter case "print" covers a generation of 3D structures and the like being producible by a 3D printer.

In general, in a print process, the print bar and a print target are moved in relation to each other. For example, the print target may be moved relative to the print bar, which is not moved, like in the case of page-wide-array printers. It is also possible that the print target is not moved, while the print head is moved, like in the case of 3D printers.

Defects of single nozzles of a print head may result in printing artifacts. Movements of the print bar and the print target in relation to each other may result in different aging of the nozzles. Thus, some nozzles are more used than others and, hence, degrade faster. This may also lead to visible printing irregularities. To address these aspects, multi-pass printing may be used in page-wide array printers and 3D printers. In multi-pass printing overlapping portions of a print target are printed on multiple times, wherein the print target or the print head is moved forwards and backwards (i.e. in the opposite direction) in a "two step forward one step backward" style. Information on multi-pass printing used in page-wide array printers can be found in U.S. Pat. No. 8,057,010 B2.

Figures may show a print target for demonstration purposes. However, the print target is typically not a component of the printer.

DETAILED DESCRIPTION OF THE DRAWINGS

Figure 1:
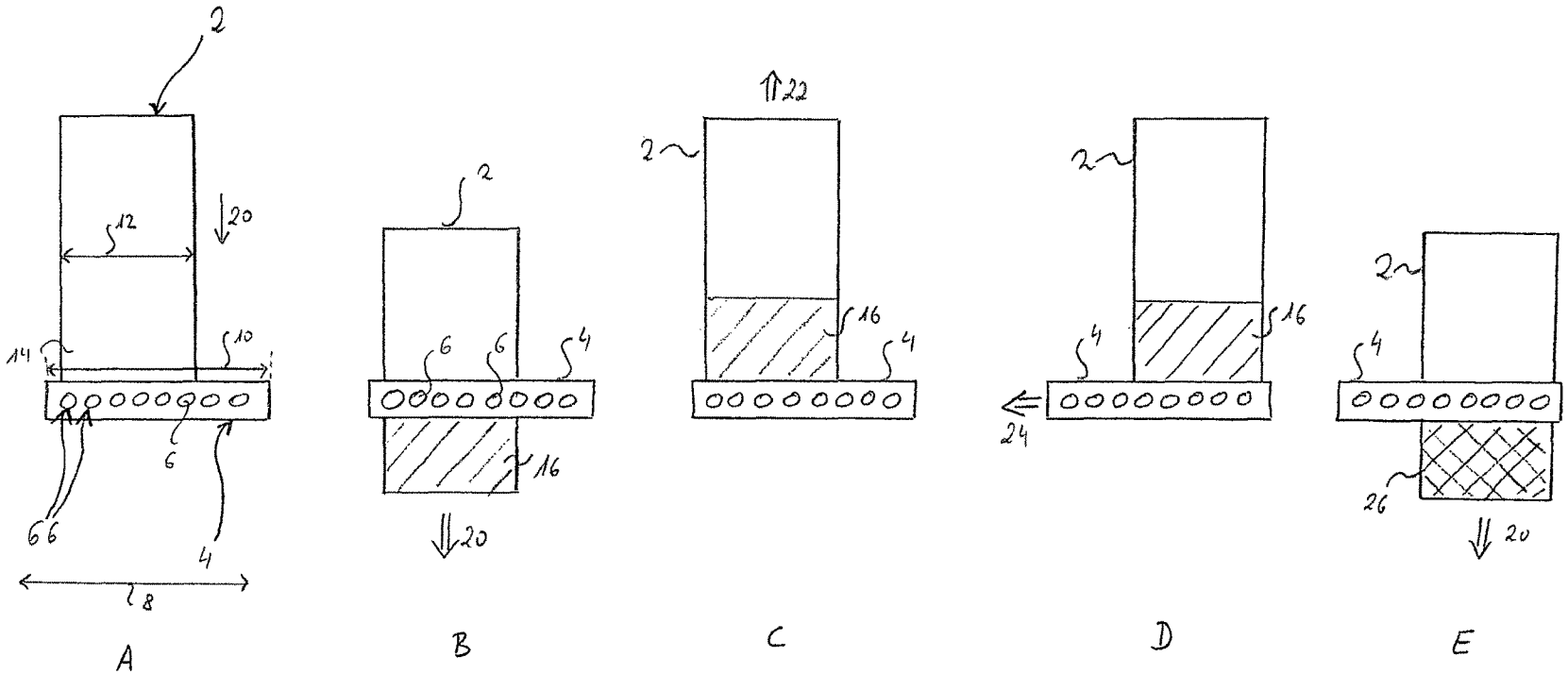
FIG. 1 illustrates the operation of a multi-pass page-wide-array printer according to one example.

FIG. 1 schematically illustrates multi-pass printing in a page-wide-array printer. However, before proceeding further with a detailed description of FIG. 1, further aspects are discussed.

An aspect provides a print bar for a multi-pass printer. The print bar comprises a static part and a movable part. The static part may be configured to extend across a print area of the print target and comprises an indexing profile having a longitudinal axis. The moveable part may comprise a print bar beam defining an elongated space through which the indexing profile extends. The print bar beam is supported on the indexing profile movably in an indexing direction extending parallel to the longitudinal axis of the indexing profile.

In some examples, the printer may be a page-wide-array printer for 2D print processes. In some examples, the printer may be a printer for 2D print processes, wherein the printer may be also a page-wide-array printer.

In some examples of the print bar, the print bar may further comprise an actuation device being operatively coupled with the print bar beam for moving the same in the indexing direction.

In some examples of the print bar, the print bar beam may be supported on the indexing profile by means of at least two sliders, which provide only one translational degree of freedom for the print bar beam for movement of the print bar beam in the indexing direction.

In some examples of the print bar, the at least two sliders may provide a rotational degree of freedom for the print bar beam for rotation of the print bar beam about a pivot axis extending in a direction parallel to the indexing direction.

In some examples of the print bar, the at least two sliders may comprise a rear slider providing a contact point, and at least one front slider, wherein each of the at least one front slider provides at least one contact point.

In some examples of the print bar, the at least two sliders may comprise a first front slider providing two contact points and a second front slider providing two contact points, wherein the two contact points of the first front slider and two contact points of the second front slider define a pivot axis for the print bar beam, wherein the pivot axis extending in a direction parallel to the indexing direction.

In some examples of the print bar, the rear slider or its contact point may be movable, and a movement of the rear slider or its contact point may pivot the print bar beam about the pivot axis.

In some examples of the print bar, the at least two sliders may provide five contact points so that the print bar beam is isostatically supported with five translational constraints and a single translational degree of freedom.

In some examples of the print bar the actuation device may comprise a motor, and a gear transmission, wherein the print bar beam may comprise a rack being operatively coupled with the gear transmission.

In some examples of the print bar, the print bar may further comprise at least one of a series of print heads and a series of latches, each of which being arranged on the print bar beam in a cantilever configuration.

In some examples of the print bar, the print bar may further comprise a first lift bracket being connected to a first end of the indexing profile and a second lift bracket connected to a second end of the indexing profile.

Another aspect provides a multi-pass printer and further comprising a print bar. The print bar comprises a static part and a movable part. The static part may be configured to extend across a Print area of the print target and comprises an indexing profile having a longitudinal axis.

The moveable part may comprise a print bar beam defining an elongated space through which the indexing profile extends. The print bar beam is supported on the indexing profile movably in an indexing direction extending parallel to the longitudinal axis of the indexing profile.

In some examples, the printer may be a page-wide-array printer for 2D print processes. In some examples, the printer may be a printer for 2D print processes, wherein the printer may be also a page-wide-array printer.

In some examples, the printer may further comprise an actuation device being operatively coupled with the print bar beam for moving the same in the indexing direction.

In some examples of the printer, the print bar beam may be supported on the indexing profile by means of at least two sliders, which provide only one translational degree of freedom for the print bar beam for movement of the print bar beam in the indexing direction.

In some examples of the printer, the at least two sliders may provide a rotational degree of freedom for the print bar beam for rotation of the print bar beam about a pivot axis extending in a direction parallel to the indexing direction.

In some examples of the printer, the at least two sliders may comprise a rear slider providing a contact point, and at least one front slider, wherein each of the at least one front slider provides at least one contact point.

In some examples of the printer, the at least two sliders may comprise a first front slider providing two contact points and a second front slider providing two contact points, wherein the two contact points of the first front slider and two contact points of the second front slider define a pivot axis for the print bar beam, wherein the pivot axis extending in a direction parallel to the indexing direction.

In some examples of the printer, the rear slider or its contact point may be movable, and a movement of the rear slider or its contact point may pivot the print bar beam about the pivot axis.

In some examples of the printer, the at least two sliders may provide five contact points so that the print bar beam is isostatically supported with five translation constraints and a single translational degree of freedom.

In some examples of the printer, the actuation device may comprise a motor, and a gear transmission, wherein the print bar beam comprises a rack being operatively coupled with the gear transmission.

In some examples, the printer may further comprise at least one of a series of print heads and a series of latches, each of which is arranged on the print bar beam in a cantilever configuration.

In some examples of the printer, the print bar may further comprise a first lift bracket being connected to a first end of the indexing profile, and a second lift bracket connected to a second end of the indexing profile; wherein the printer may further comprise a first lift device operatively coupled to the first lift bracket, the first lift device being adapted to move the first lift bracket in a direction perpendicular to the print area, and a second lift device operatively coupled to the second lift bracket, the second lift device being adapted to move the second lift bracket in a direction perpendicular to the print area.

Here, if not otherwise specified, the term "longitudinal direction" refers to the direction of net movement of the print target and the print head in relation to each other during a printing process, which is also called the feeding direction. As already note above, during a multi-pass printing process, the print target or the print head is moved in "two step forward one step backward" style, i.e. forward to some extent, then backward in an extent smaller than the previous forward movement and so on. The resulting net movement, i.e. movement in the feeding direction, moves the print target underneath the print bar through the printer (in the case the print target is moved) or moves the print head above the print target through the printer (in the case the print head is moved).

The term "vertical direction" refers to a direction perpendicular to the print target's plane, which plane is also referred to as print area.

The term "static part" particularly refers to a part of the print bar, which may be movable in a direction differing from a direction parallel to the longitudinal axis of the indexing profile and the indexing direction, respectively, for example, in a direction perpendicular to the print area. However, in some examples the "static part" cannot be moved in a direction parallel to the longitudinal axis of the indexing profile and the indexing direction, respectively.

The term "movable part" refers to that part of the print bar, which can be moved in a direction parallel to the longitudinal axis of the indexing profile and the indexing direction, respectively. However, the "static part" of the print bar may be movable also in a different direction, for example, may be pivoted around an axis parallel to the longitudinal axis of the indexing profile and the indexing direction, respectively.

The term "slider" relates to elements connected to the print bar beam or the indexing profile and supporting, one the one hand, the print bar beam (and, thus, the movable part) and, on the other hand, the indexing profile (and, thus, the static part) with respect to each other. A slider may be connected to the print bar beam so that the indexing profile is movably supported thereon. A slider may be connected to the indexing profile so that the print bar beam is movably supported thereon. A slider can comprise at least one contact pad providing a contact surface or contact point for the print bar beam or the indexing profile depending to which thereof the slider is connected. A slider or, if applicable, its contact pad may permit a low-friction movement thereon.

The term "lateral direction", also referred to as "indexing direction", refers to a direction perpendicular to both the longitudinal direction and the vertical direction, i.e. in a direction across the print area.

Typically, but not necessarily, the print bar extends primarily into the lateral direction and in parallel to the print target plane.

In some examples, the print bar beam is rotatable or pivotable around an axis extending in lateral direction and the indexing direction, respectively.

In some examples, the vertical position of the print bar with respect to the print area printer is adjustable. A vertical adjustment may serve to reach various positions, including those for print head replacement, capping, wiping, spitting, drop detection or printing.

In some examples, the vertical adjustment of the print bar is independently of a lateral movement of the print bar beam.

In some examples, the vertical adjustment is achieved by means of two lift brackets, one at each end of the print bar.

In some examples, the lift brackets can be positioned at same positions in the vertical direction. As a result, the print bar can be positioned closer or more far away from the print area and the print target, respectively.

In some examples, the lift brackets can be positioned at different positions in the vertical direction. As a result, the print bar can be rotated or pivoted about an axis extending in longitudinal direction. This allows to adjust the print bar position in relation to lateral extension/dimension of the print area and the print target, respectively.

In some examples, the motor of the actuation device is an electrical, piezoelectric, hydraulic, or similar motor generating a translational or rotational movement.

In some examples, the transmission may comprise at least one of gear(s), pinion(s), ratchet(s) and rack(s) to transmit the generated movement onto the print bar beam. The movement may be up- or down-shifted during transmission. In some further examples, the motor and/or transmission may be placed within the volume of the print bar and/or indexing mechanism, which may lead to a compact design.

In some examples, the printer further comprises a controller configured to control the print bar and, particularly, movements thereof. In some examples, the controller is configured to control the lateral movement of the print bar beam in at least one of the indexing direction and an opposite direction. In some examples, the controller is configured to control the activation of the actuation device and, particularly, its motor. In some examples, the controller is configured to control vertical movements of at least one of the first lift bracket and the second lift bracket.

FIG. 1 illustrates the operation of a multi-pass page-wide-array printer. FIG. 1 shows a print target 2 (e.g. paper, foil), which is to be printed on using a print bar 4 equipped with nozzles 6. The nozzles 6 may be arranged on a print head or array of print heads (see e.g. FIGS. 7 and 8). Just for simplification, FIG. 1 shows merely eight nozzles 6. In practice, the numbers of nozzles can vary and may reach several thousands of nozzles or more.

In FIG. 1, arrow 8 indicates the lateral direction, also referred to as indexing direction. In the lateral direction 8, the print bar 4 has a length 10 larger than a width 12 of the print target 2.

Figure 4:
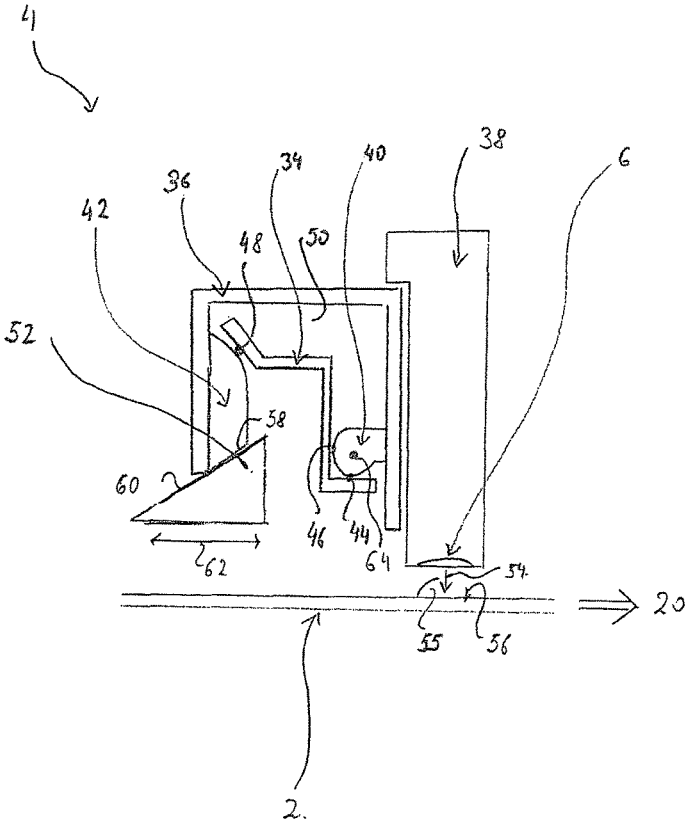
FIG. 4 illustrates a cross-sectional view of an print bar according to one example.

FIG. 1A shows an initial phase of a multi-pass printing process. The print target 2 is positioned with respect to the print bar 4 such a portion 14 where the print process starts. The portion of the print target 2 located beneath the print bar 4 is referred to a print area, i.e. that area of the print target 2 where the print bar 4 is currently positioned for printing onto the print target 2. In FIG. 1, the print area is covered by the print bar 4 due to the perspective of FIG. 1, but, for example, FIG. 4 shows a print area. In the initial phase, the print bar 4 is positioned such that some of the nozzles at the right-hand side of the print bar 4 are not positioned above the print target 2 and, thus, are not used in the print process since they are not positioned above the print area.

FIG. 1B shows a phase of the multi-pass printing process, where some of the print target 2 has been printed on. This is illustrated by the hatched area 16 of the, print target 2. To this end, the print target 2 has been moved from its position in FIG. 1A to the position in FIG. 1B—as indicated by arrow 20 in FIG. 1A—during which movement the hatched area 16 is printed onto. The direction of this movement is also referred to a longitudinal or feed direction 20. During this movement of the print target 2, the print bar 4 is in the same position as in FIG. 1A.

FIG. 1C shows a phase of the multi-pass printing process, before which the print target 2 has been moved, from its position in FIG. 1B, in a direction 22 opposite to the longitudinal or feed direction 20 until the position in FIG. 1C is reached. During this retraction of the print target 2, the print bar 4 is also in the same position as in FIG. 1A and FIG. 1B, respectively.

Then, as shown in FIG. 1D, the print bar 2 is moved in lateral direction 24, i.e. perpendicularly the longitudinal or feed direction 20. As a result, the print bar 4 is positioned such that some of the nozzles at the left-hand side of the print bar 4 are not positioned above the print target 2 and, thus, are not used in the print process since they are not positioned above the print area. Similarly, some of the nozzles at the right-hand side of the print bar 4, which were not used in the first print pass process (FIG. 1B), are now positioned above the print target 2.

FIG. 1E shows that the print target 2 has been again moved in longitudinal or feed direction 20, wherein the part of the print target 11, which has been moved underneath the print bar 4, is again printed on. This is illustrated by the double-hatched area 16 of the print target 2.

According to FIG. 1, the parts 16 and 26 of the print target 2 that have been printed on are the same and overlap completely. However, the part 16 and the part 26 may have different sizes and, overlap only partially, depending on the distance the print target 2 has been moved forward (FIG. 1B) and backward (FIG. 1C).

The movement of the print bar 4 from its position in FIG. 1B to its position in FIG. 1C allows an at least more even use of the nozzles 6. This limits the effect of nozzles, which do not work properly due to, e.g., aging, clotting, etc., on the print quality.

For printing onto the whole pint media 2, the above described phases of the printing process can be repeated for the parts 16 and 26 of the print target at least once more and will be carried out in similar manner for the remaining parts of the print target 2.

Figure 2:
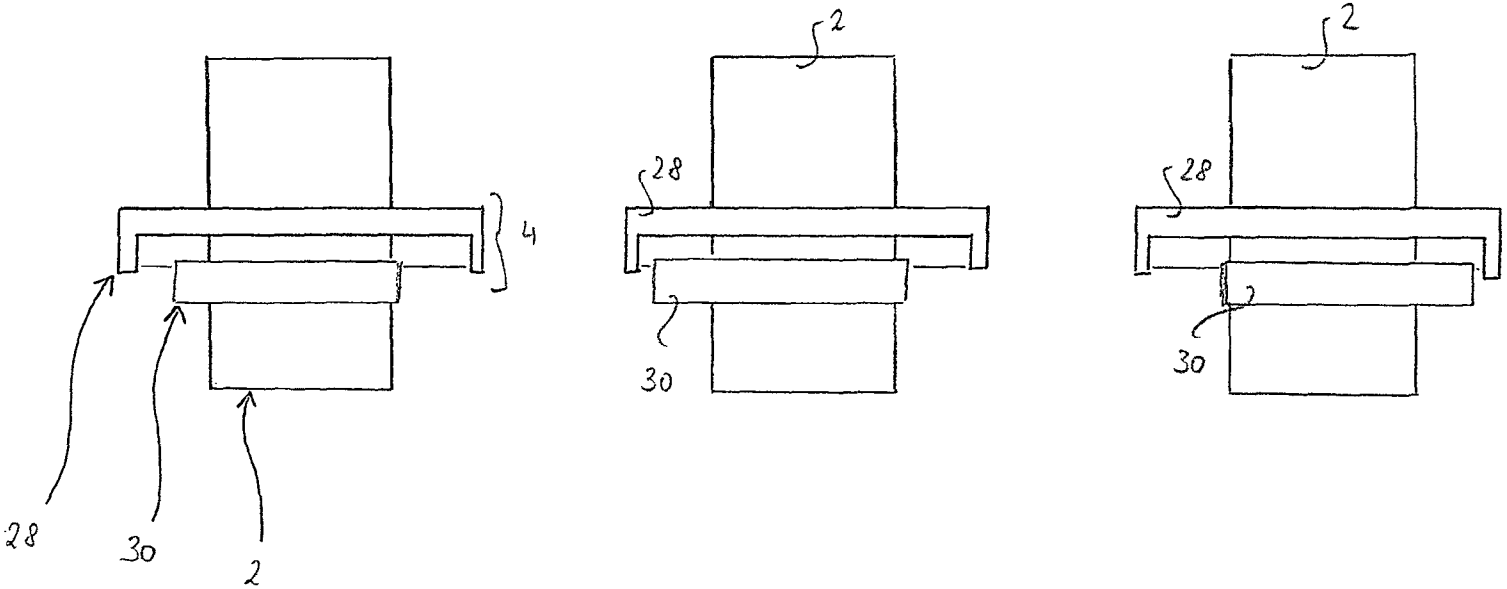
FIG. 2 illustrates the relative movement of the moveable and static parts of a multi-pass page-wide-array printer according to one example.

FIG. 2 shows a print bar 24 having a static part 28 and a moving part 30. As described further below in greater detail, the static part 28 may include, inter alia, an indexing profile and the moving part 30 may include, inter alia, a print bar beam equipped with print heads each thereof having nozzles.

FIG. 2A assumes that the moving part 30 is centrally aligned with the static part 28 as initial configuration for a first phase (or first pass) of a multi-pass print process. However, the initial positions of the static part 28 and the moving part 30 in relation to each other is not relevant since any positioning ensures that the width 12 of the print target 2 is covered by a part of the moving part 30 and, particularly, nozzles 6 thereof.

FIG. 2B shows the moving part 30 with a lateral displacement to the left with respect to the static part 28. The static part 28 and the print target 2 remain in their respective positions. The moving part 30 and, particularly, nozzles 6 thereof still cover the entire width 12 of the print target 2. This positioning may be used for a second phase (of second pass) of the multi-pass print process.

FIG. 2C shows the moving part 30 with a lateral displacement to the right with respect to the static part 28. The static part 28 and the print target 2 remain in their respective positions. The moving part 30 and, particularly, nozzles 6 thereof still cover the entire width 12 of the print target 2. This positioning may be used for a third phase (of third pass) of the multi-pass print process.

It is noted that the different positioning of FIG. 2 merely represent examples and that more or less different positions and movements, respectively, of the movable part 30 can be employed.

Figure 3:
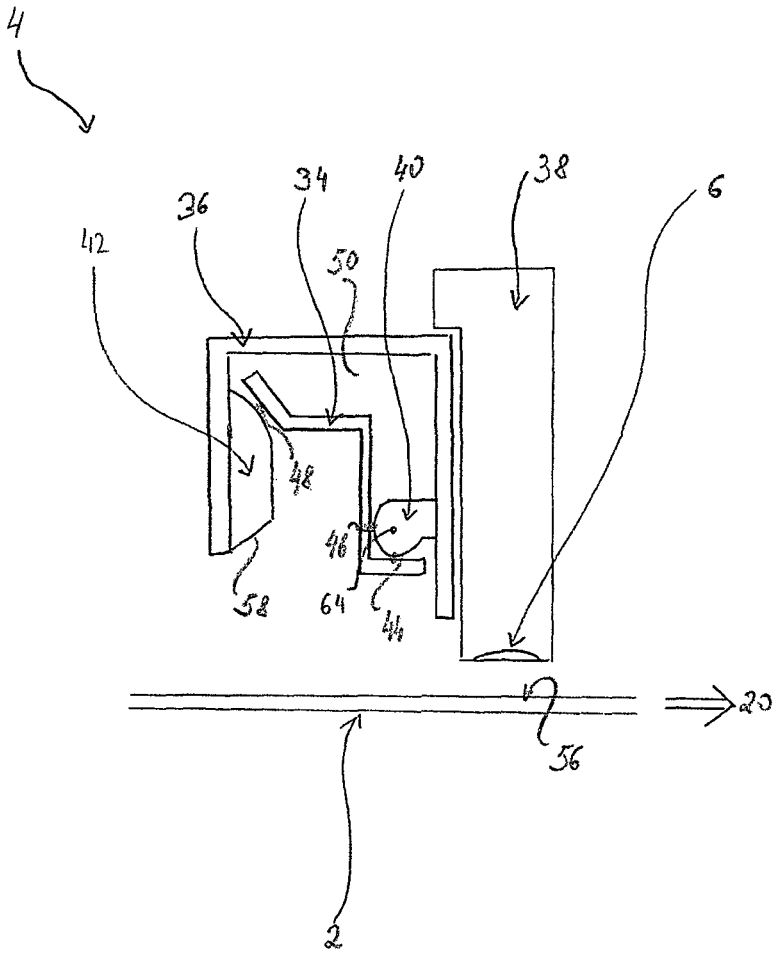
FIG. 3 illustrates a cross-sectional view of a print bar according to one example.

FIG. 3 illustrates a cross-sectional view of a print bar 4 having an indexing profile 34 being part of a static part of the print bar 4. Further, there is a print bar beam 36 being part of a movable part of the print bar 4. The print bar beam 36 is equipped with at least one print head 38 having nozzles 6. Being connected with print bar beam 36, the print head 38 is also a component of the moving part of the print bar 2. The print head(s) 38 are connected to the print bar beam 36 in a cantilevered configuration.

FIG. 3 also shows a print target 2 and indicates the feed direction 20.

As described in detail further below, the indexing profile 34 is configured to be installed in a printer (particularly a page-wide-array printer), while the print bar beam 36 has no direction contact with the printer. Thus, the indexing profile 34 can act as support for the print bar beam 36. To this end, sliders 40 and 42 are provided.

According to FIG. 3, the sliders 40 and 42 are connected to the print bar beam 36 and provide contact points 44, 46 and 48 for the indexing profile 34. However, at least one of the sliders can be connected to the indexing profile 34 and provide its contact point for the print bar beam 36. This variation is also contemplated for all other sliders referred to in the following.

Further, it is also contemplated that at least one of the sliders does provide, in place of a contact point, a contact line extending in a direction parallel to the lateral or indexing direction. In such a case, a contact line may extend about the whole lateral extension of the print bar beam or the indexing profile or may have any length being shorter. Also this variation is again contemplated for all other sliders referred to in the following.

The indexing profile 34 serves as support for the print bar beam 36, which can moved and positioned along the indexing profile 34. The indexing profile 34 and the sliders 40 and 42 are arranged in a space 50 in the print bar beam 36. As a result, a volume-saving arrangement is achieved. Further, this arrangement allows to use a cantilever-style connection of the print head 38 to the print bar beam 36.

FIG. 4 illustrates a further example comprising the components of FIG. 3 and an adjustment device 52. The adjustment device 52 serves to adjust the direction in which the print head applies printing substance (e.g. ink, dye, toner, etc.) onto the print target. As illustrated in FIG. 4, the print head 38 has a printing medium ejection direction 54. A good printing quality usually requires a certain angle 55 between the printing medium ejection direction 54 and a print area 56, for example 90 degrees. In order to adjust the print bear beam 36 and, thus, the print head 38 connected therewith, i.e. to adjust the printing medium ejection direction 54, the adjustment device 52 can be used to pivot the print bar beam 36 about a pivot axis extending parallel to the lateral direction 8. In the shown example, the adjustment device 52 is configured to displace the slider 42 vertically, i.e. perpendicular to the plane of the print area 56. In the shown example, the slider 42 has a lower surface 58 being inclined with respect to the plane of the print area 56, while the adjustment device 52 has an upper surface having essentially the same inclination. Thus, it can be said that the adjustment device 52 is wedge-shaped. The adjustment device 52 is movable in directions parallel to the feed direction 20; such movements to the right and left in FIG. 4 are illustrated by the arrow 62.

Moving the adjustment device 52 in the feed direction 20 (to the right in FIG. 4), its upper surface 62 engages the lower surface 60 of the slider 42. As a result, the slider 42 is moved upwards. Due this movement, the print bar beam 36 and, effected by the contact point 48, the indexing profile 34 are pivoted in clock-wise direction. The contact points 44 and 46 of the slider 40 define a pivot axis 64, about which the print bar beam 36 and the indexing profile 34 are pivoted.

Moving the adjustment device 52 in the direction opposite to the feed direction 20 (to the left in FIG. 4), moves the slider 42 is moved downwards. Due this movement, the print bar beam 36 and, effected by the contact point 48, the indexing profile 34 are pivoted in anti-clock-wise direction about the pivot axis 64, about which the print bar beam 36 and the indexing profile 34 are pivoted.

In some examples, the sliders 44 and 46 have double curvature towards the indexing profile 34. The double curvature allows for a single point of contact between each of the sliders 44 and 36 and the indexing profile 34 in various degrees of inclination. The single point of contact supports low-friction sliding movements.

As can be seen from the arrangement of FIG. 4, the change of inclination can be achieved independently from the lateral movement between print bar beam 38 and indexing profile 34.

The change of inclination may be used to restore the parallelism between the print bar beam 38 and its print head(s) 38 and the print target 11.

Figure 5:
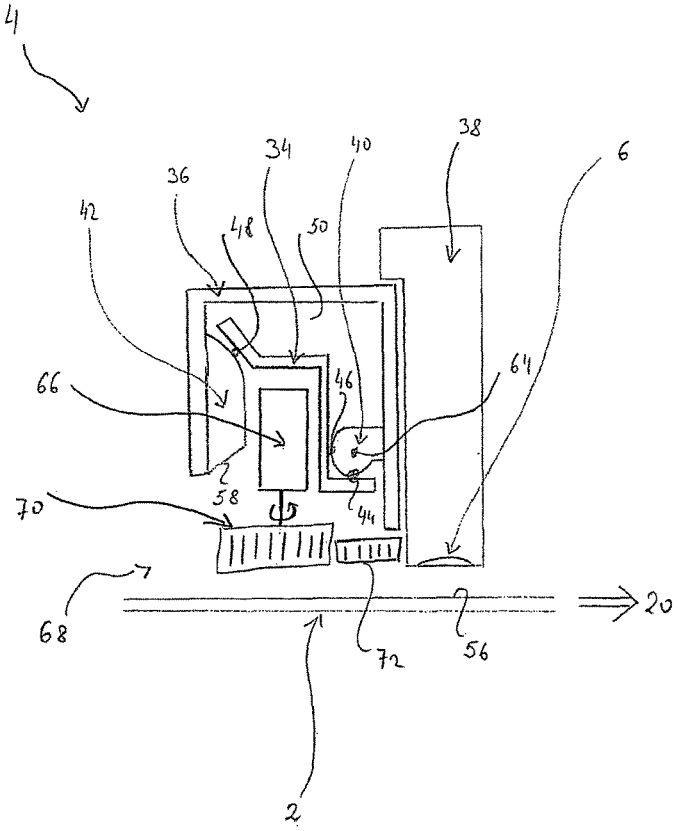
FIG. 5 illustrates a cross-sectional view of an print bar according to one example.

FIG. 5 illustrates a further example comprising the components of FIG. 3. The example of FIG. 5 may also include the adjustment device 52 of FIG. 4. In addition, the example of FIG. 5 comprises a motor 66 and a transmission 68. The motor 66 and transmission 68 are housed within the space 50 of the print bar beam 36, further minimizing space needed within a printer.

The motor 66 can be a rotary electrical motor connected to the transmission 68. In the illustrated example, the transmission 68 comprises a gear 70 and a ratchet or rack 72. The gear 70 is coupled with the motor 66 and can be rotated by the motor 66. The gear 70 is engagement with the ratchet 72, whereby a rotation of the gear 70 results in a movement of the ratchet 72 in lateral direction 8. The ratchet 72 is connected to the print bar beam 36. Thus, rotation of the motor is transmitted through the gear 70 and ratchet 72 is translated into a lateral movement of the print bar beam 36.

Figure 6:
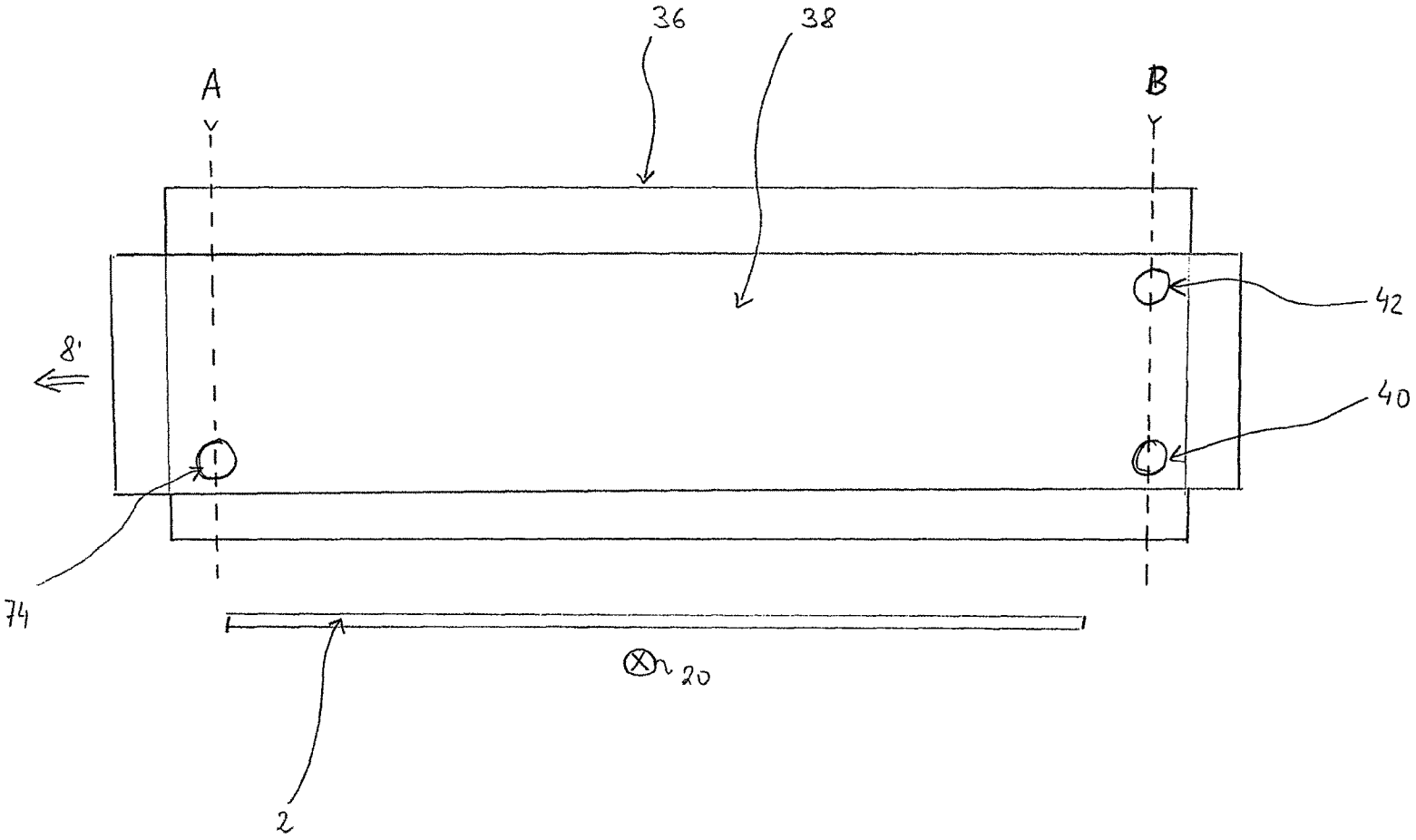
FIG. 6 illustrates a view on a longitudinal side of an print bar according to one example.

FIG. 6 illustrates a view on a longitudinal side of a print bar 4 comprising a print bar beam 36, an indexing profile 38 and three sliders 40, 42 and 74. The print target 11 is shown below the arrangement and may be moved in directions parallel to the longitudinal direction 20. In particular, two front sliders 40 and 74 and one rear slider 42 are shown. The sliders 40 and 74 are solidly fixed to the print bar beam 36 and form a (low-friction) contact with the indexing profile 34. The section B may be one of those shown in FIGS. 3 to 5. Section A does not feature a rear slider. Each front slider 40 and 74 forms two points of contact with the indexing profile 34. The rear slider 42 forms one point of contact with the indexing profile 34. Thus, a total of five points of contact are formed between the print bar beam 36 and the indexing profile 34 via the sliders 40, 42 and 74. As a result, the print bar beam 36 and the indexing profile 34 are a statically determinate system with one degree of freedom for the lateral movement of the print bar 12 in lateral direction 8.

The example illustrated in FIGS. 7 to 14 includes components described above with reference to FIGS. 3 to 6 or components providing at least comparable functions. Therefore, the above given description also applies to the example illustrated in FIGS. 7 to 14 and, hence, are not repeated here. In the following, merely different, additional components and functions, respectively, are described.

Figure 7:
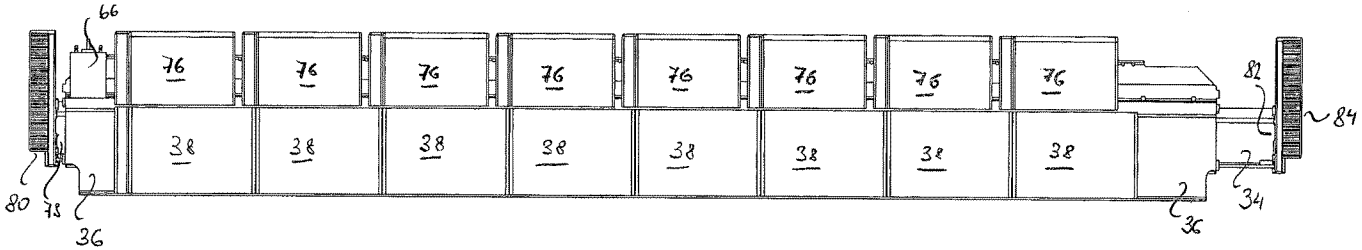
FIGS. 7 to 11 show a further print bar according to one example.
Figure 8:
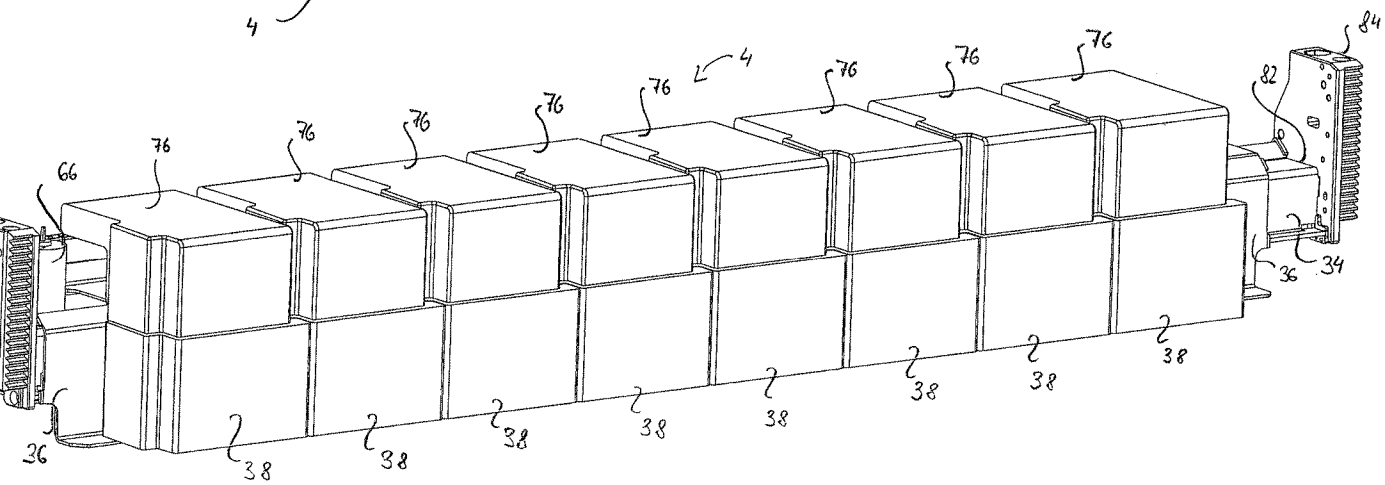
Figure 9:
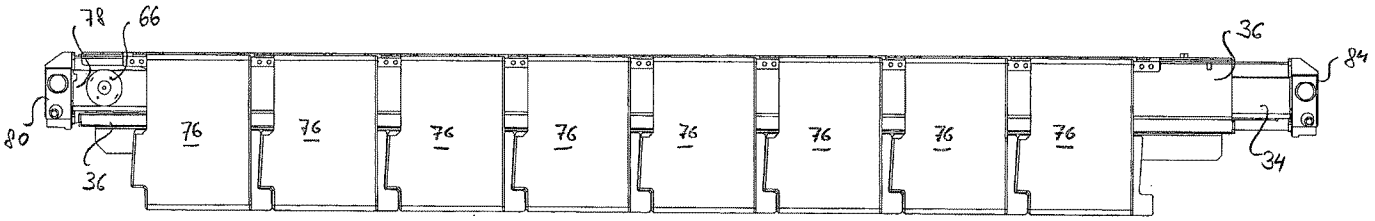
Figure 10:
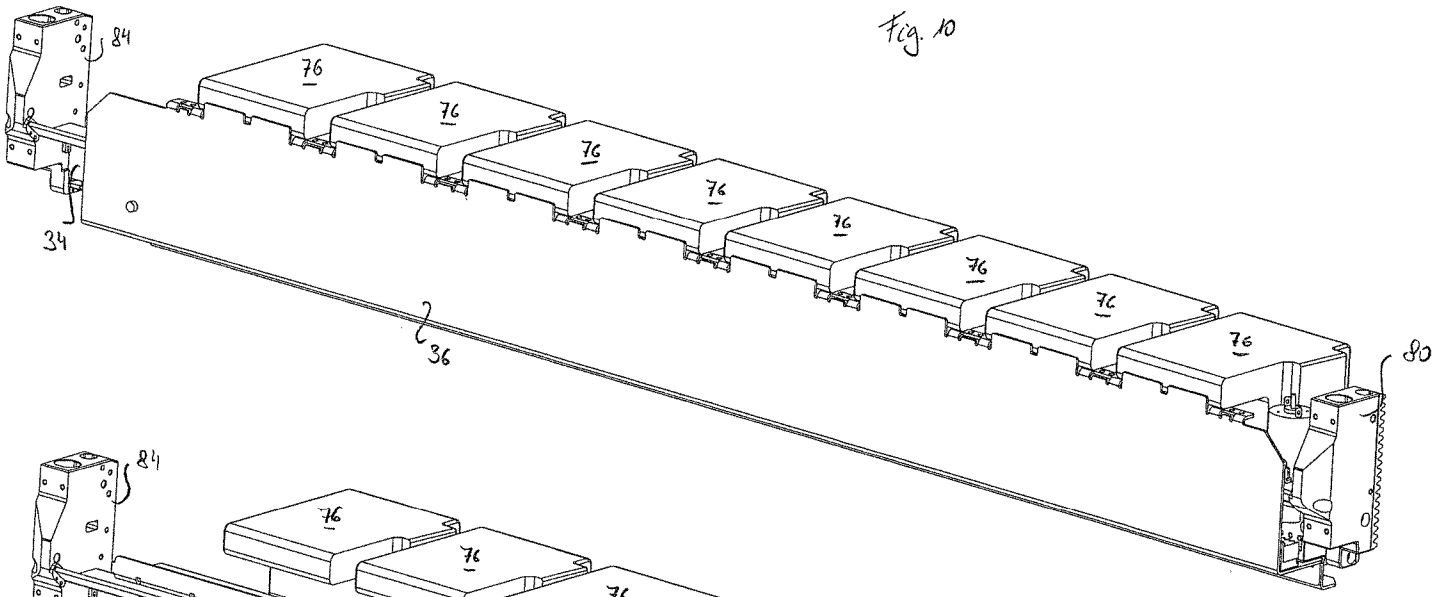

As shown in, for example, FIGS. 7 and 8, the print bar 4 comprises latches 76. The latches 76 are arranged on the print bar beam 36, like its print heads 38 in a cantilevered configuration.

Further, the indexing profile 34 has a first end 78 being connected with a first lift bracket 80 and a second end 82 being connected with a second lift bracket 84. Using the print bar 4 in a printer, the lift brackets 80 and 84 serve to adjust the vertical positioning of the print bar 4. In some examples, the lift brackets 80 and 84 can be actuated independently of each other so that the print bar 4 can be inclined with respect to the lateral direction. In other words, in such examples, the distances of the first end 78 and the second end 82 of the indexing profile 34 to the print target 2 can be different.

Figure 14:
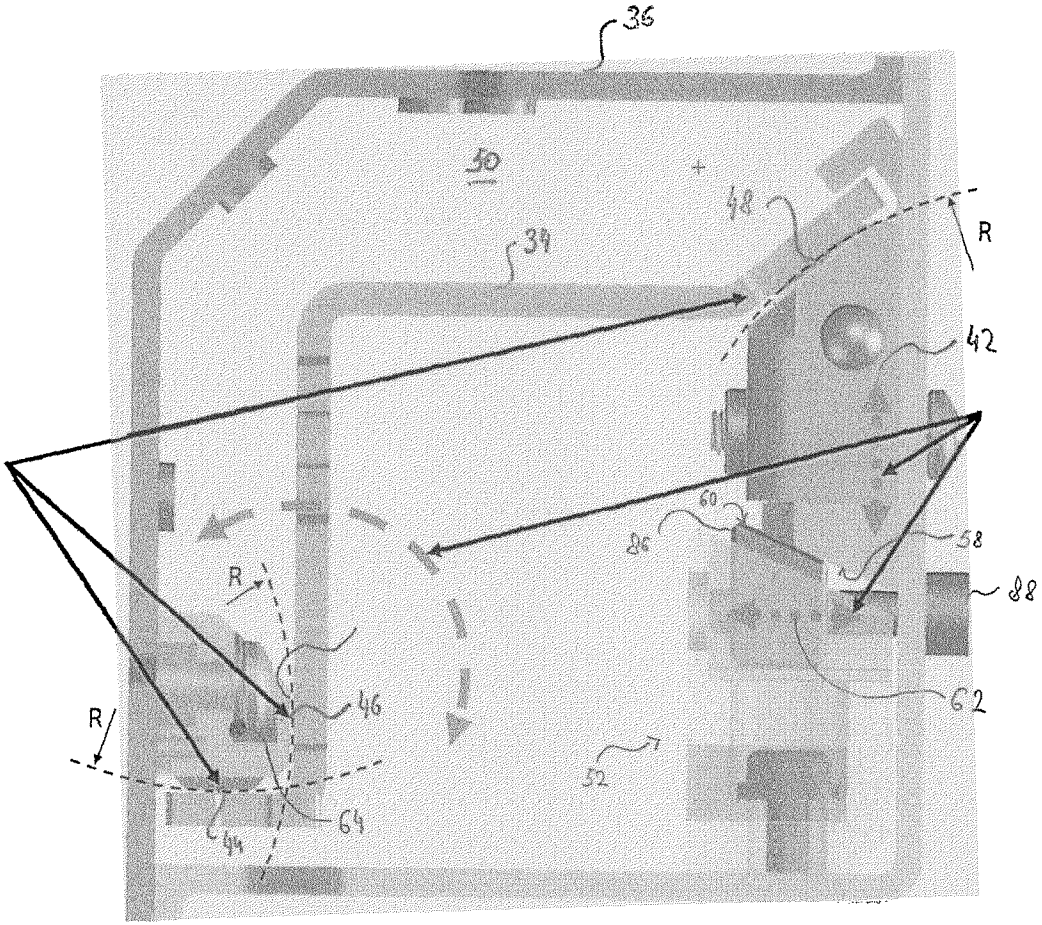
FIG. 14 shows a further cross-sectional view of the exemplary print bar of FIGS. 7 to 11.

As shown, for example, in FIG. 14, the indexing profile 34 is placed inside the print bar beam 36 and has three control planes on which the sliders 40, 42 and 74 repose and slide in the range of the indexing movement.

The sliders 40, 42 and 74 may be rigidly attached to the print bar beam 36 and move with it. Each of the two front sliders 40 and 74 has two sliding pads, one in longitudinal/feed direction and one in vertical direction, proving contact points.

The rear slider 42 has the contact point 48 and may be also rigidly attached to the print bar beam 36. The rear slider 42 has the particularity that the vertical position of its contact point 48 can be adjusted, for example, before its final attachment to the print bar beam 36. This allows a control of a rotation of the print bar beam 36 and, particularly, its printing heads 38 around an axis being parallel to the lateral direction in order to maintain the print heads 38 parallel to the print target to be printed on.

The adjustment device 52 of the rear slider 42 comprise a sliding wedge 86, actuated with a screw 88, which is linked with the vertical movement of the rear slider 42, and therefore with a rotation or pivoting movement of the print bar beam 36 around the pivot axis 64.

The rear slider 42 and the two front sliders 40 and 74 may have the contact pads with double curvature, in order to ensure a single point of contact between them and the indexing profile 34 (see e.g. FIG. 14)

This allows to adjust the Pen-to-Paper-Space (PPS) by means of the lift brackets 80 and 84 and the rotation of the print heads 38 around the pivot axis 64 by means of the adjustment of the rear slider 42.

In the illustrate example of FIGS. 7 to 11, there are five contact points between the print bar beam 36 and the indexing profile 34 making the system statically determinate (isostatic), for example, giving one and only one translational degree of freedom for the lateral indexing of the print bar beam 36.

Figure 11:
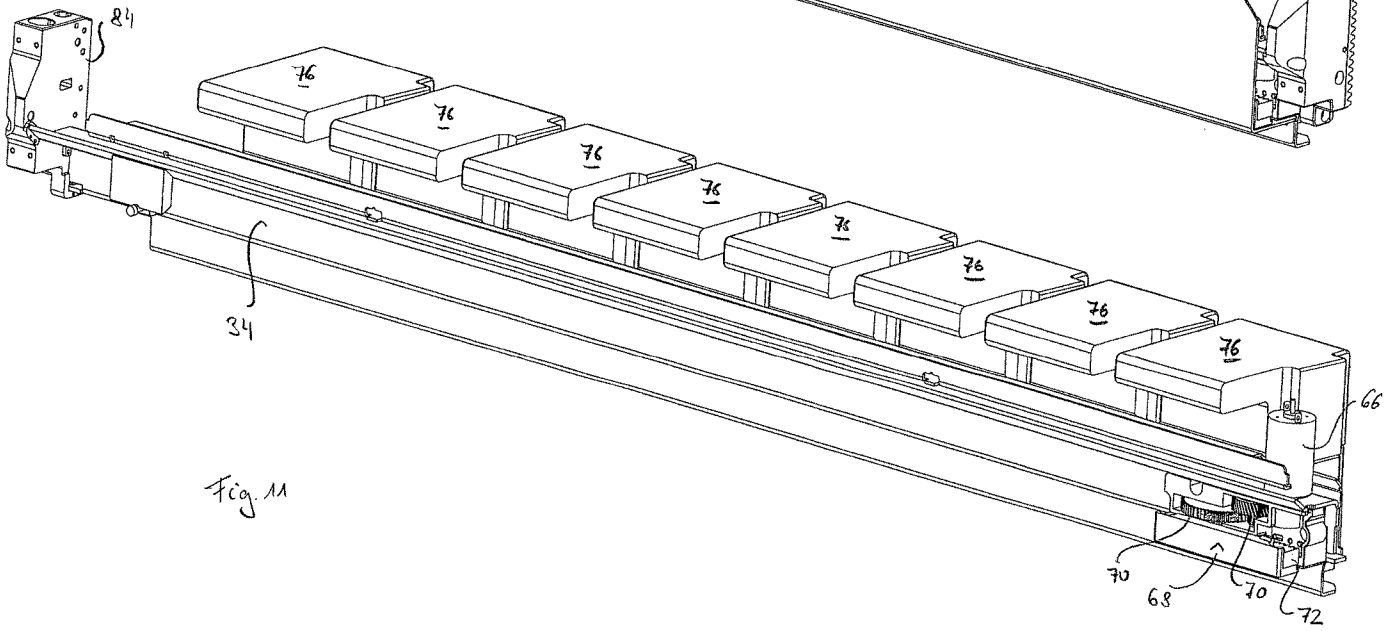
Figure 13:
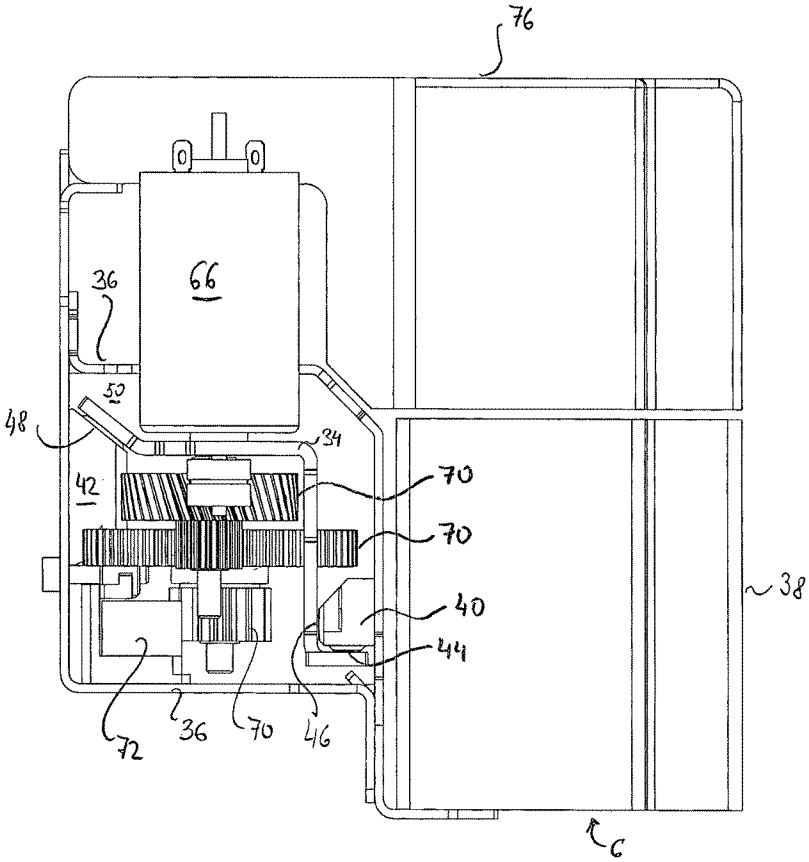
FIG. 13 shows further details of the exemplary print bar of FIGS. 7 to 11.
Figure 12:
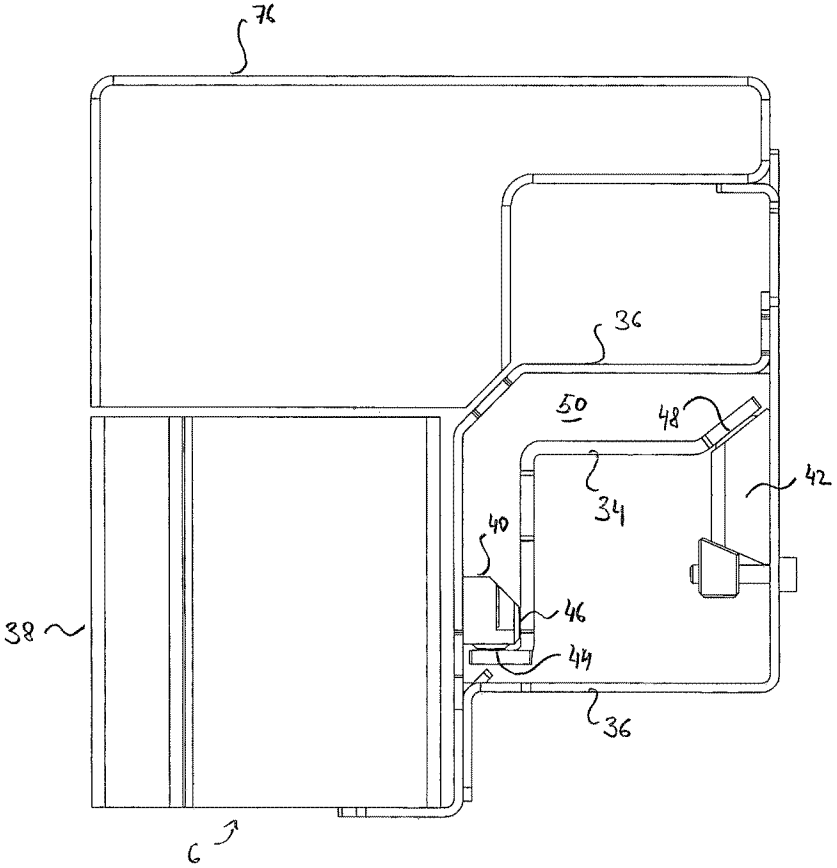
FIG. 12 shows a cross-sectional view of the exemplary print bar of FIGS. 7 to 11.

This translational degree of freedom can be actuated by the motor 66 and transmission 68, which e.g. comprises 2 stages of gears 70 and the rack 72 (see e.g. FIGS. 11 and 13). The whole transmission 86 can be placed in the volume available inside the print bar beam 36 and the motor 66 can be placed, e.g. on top of the indexing profile 34 (see e.g. FIGS. 11 and 13). This allows that that the gears 70 and the motor 66 are parts of the static part 28 of the print bar 4, while the rack 72 is a part of the moving part 30 of the print bar 4 and, thus, moves with the print bar beam 36, the print heads 38 and the latches 76.

The invention claimed is:

1. A print bar for a for a multi-pass printer, the print bar comprising:

a static part configured to extend across a print area of a print target, the static part comprising an indexing profile having a longitudinal axis; and a moveable part comprising a print bar beam defining an elongated space through which the indexing profile extends, the print bar beam supported on the indexing profile movably in an indexing direction parallel to the longitudinal axis of the indexing profile.

2. The print bar according to claim 1, further comprising an actuation device being operatively coupled with the print bar beam for moving the same in the indexing direction.

3. The print bar according to claim 1, wherein the print bar beam is supported on the indexing profile by means of at least two sliders, which provide only one translational degree of freedom for the print bar beam for movement of the print bar beam in the indexing direction.

4. The print bar according claim 3, wherein the at least two sliders provide a rotational degree of freedom for the print bar beam for rotation of the print bar beam about a pivot axis extending in a direction parallel to the indexing direction.

5. The print bar according to claim 3, wherein the at least two sliders comprise a rear slider providing a contact point, and at least one front slider, wherein each of the at least one front slider provides at least one contact point.

6. The print bar according to claim 5, wherein the at least two sliders comprise a first front slider providing two contact points and a second front slider providing two contact points, wherein the two contact points of the first front slider and two contact points of the second front slider define a pivot axis for the print bar beam, wherein the pivot axis extends in a direction parallel to the indexing direction.

7. The print bar according to claim 6, wherein the rear slider or its contact point is movable, and a movement of the rear slider or its contact point pivots the print bar beam about the pivot axis.

8. The print bar according to claim 3, wherein the at least two sliders provide five contact points so that the print bar beam is isostatically supported with five translational constraints and a single translational degree of freedom.

9. The print bar according to claim 2, wherein the actuation device comprises a motor, and a gear transmission, the print bar beam comprises a rack being operatively coupled with the gear transmission.

10. The print bar according to claim 1, further comprising at least one of a series of print heads and a series of latches, each of which being arranged on the print bar beam in a cantilever configuration.

11. The print bar according to claim 1, further comprising a first lift bracket being connected to a first end of the indexing profile and a second lift bracket connected to a second end of the indexing profile.

12. A multi-pass printer comprising a print bar according to claim 1.

13. The multi-pass printer according to claim 12, wherein the print bar further comprises a first lift bracket being connected to a first end of the indexing profile, and a second lift bracket connected to a second end of the indexing profile;

the printer further comprises a first lift device operatively coupled to the first lift bracket, the first lift device being adapted to move the first lift bracket in a direction perpendicular to the print area, and a second lift device operatively coupled to the second lift bracket, the second lift device being adapted to move the second lift bracket in a direction perpendicular to the print area.

* * * * *